US009745687B2

(12) United States Patent
Miller et al.

(10) Patent No.: US 9,745,687 B2
(45) Date of Patent: Aug. 29, 2017

(54) HEATING SYSTEM FOR A MACHINE WITH A LIGHT HEAT SOURCE

(71) Applicants: Jay Kenneth Miller, Mossville, IL (US); Daniel Robert Miller, Mossville, IL (US)

(72) Inventors: Jay Kenneth Miller, Mossville, IL (US); Daniel Robert Miller, Mossville, IL (US)

( * ) Notice: Subject to any disclaimer, the term of this patent is extended or adjusted under 35 U.S.C. 154(b) by 0 days.

(21) Appl. No.: 14/937,623

(22) Filed: Nov. 10, 2015

(65) Prior Publication Data

US 2016/0130742 A1 May 12, 2016

Related U.S. Application Data

(60) Provisional application No. 62/078,777, filed on Nov. 12, 2014.

(51) Int. Cl.
*D06F 58/26* (2006.01)
*H05B 3/00* (2006.01)

(52) U.S. Cl.
CPC ..... *D06F 58/26* (2013.01); *H05B 3/0071* (2013.01)

(58) Field of Classification Search
CPC ..... F26B 21/00; F26B 21/06; D06F 58/00; D06F 58/12; D06F 58/20; D06F 58/26; D06F 58/16; H05B 3/0071
USPC ..... 34/267, 595, 606, 610; 68/19, 20; 8/149; 392/422
See application file for complete search history.

(56) References Cited

U.S. PATENT DOCUMENTS 2,727,315 A * 12/1955 Candor ..... D06F 58/02 200/61.13
2,728,481 A * 12/1955 Robinson ..... D06F 58/04 220/4.02
2,742,708 A * 4/1956 McCormick ..... D06F 58/02 34/60
2,858,618 A * 11/1958 Kauffman, II ..... D06F 58/28 34/546
2,885,789 A * 5/1959 Conkling ..... D06F 58/28 34/547
2,936,527 A * 5/1960 Hutt ..... D06F 58/04 34/549
3,018,560 A * 1/1962 Morey ..... D06F 58/28 34/527
3,099,542 A * 7/1963 Van Scoyk ..... D06F 58/02 34/547
3,368,063 A 2/1968 Kuhn
3,555,338 A * 1/1971 Scoledge ..... H01K 7/02 313/113
3,591,797 A * 7/1971 Hicks ..... F21V 7/00 362/298

(Continued)

FOREIGN PATENT DOCUMENTS

AU DE 19526282 A1 * 3/1996 ..... F21V 21/002
JP 08222672 A * 8/1996

*Primary Examiner* — Steve M Gravini
(74) *Attorney, Agent, or Firm* — Robin S. Fahlberg

(57) ABSTRACT

A heating system for a machine includes a tungsten halogen light bulb, a socket, a heat sink, and a reflector. The tungsten halogen light bulb is configured to emit light when connected to an electric power source. The socket is selectively electrically connected to the electric power source. The tungsten halogen light bulb is removeably connected to the socket. The reflector includes a reflecting surface, and is fixedly mounted in relation to the heat sink, such that the reflecting surface reflects at least a portion of the light onto the heat sink.

10 Claims, 14 Drawing Sheets

(56) References Cited

U.S. PATENT DOCUMENTS 3,684,883 A * 8/1972 Entwistle ..... F21V 29/004 362/269
5,546,678 A * 8/1996 Dhaemers ..... D06F 58/10 34/224
5,664,340 A * 9/1997 Brown ..... D06F 58/203 34/275
5,724,750 A * 3/1998 Burress ..... D06F 58/02 34/267
5,953,831 A * 9/1999 Yu ..... D06F 58/26 34/269
6,848,797 B1 * 2/2005 Gillich ..... G02B 5/0858 359/584
6,877,248 B1 * 4/2005 Cross ..... D06F 58/203 34/275
6,941,680 B1 9/2005 Zielewicz et al.
7,146,749 B2 * 12/2006 Barron ..... D06F 58/203 34/596
8,146,265 B2 * 4/2012 Oh ..... D06F 58/22 219/647
8,627,581 B2 * 1/2014 Brown ..... D06F 58/02 34/603
8,662,718 B2 3/2014 Hashimoto
8,667,702 B2 * 3/2014 Ediger ..... D06F 58/20 165/58
9,175,432 B2 * 11/2015 Del Pos ..... D06F 39/125
9,200,842 B2 * 12/2015 Hopkins ..... D06F 58/28
9,334,603 B2 * 5/2016 Oak ..... D06F 58/04
2005/0056633 A1 * 3/2005 Backus ..... A47J 37/041 219/392
2005/0102852 A1 5/2005 Mizhari
2008/0172900 A1 7/2008 Ceva
2008/0219650 A1 9/2008 Suzuki et al.
2012/0293957 A1 * 11/2012 Ji ..... G06F 1/26 361/692
2016/0130742 A1 * 5/2016 Miller ..... H05B 3/0071 34/267

* cited by examiner

Dryer Comparison Test Data

| Washer | Wattage | Water Weight Removed in 15 Minute Intervals | Total Time to Dry | Weight of Test Load |
|---|---|---|---|---|
| Washer 1 – Commercially Available Energy Star Rated | 4758 watts | 1.3 lbs. in 1st 15 minutes | 45 minutes | 8.4 lbs./ 11.4 lbs. wet |
| Washer 2 – Commercially Available | 5108 watts | 1.3 lbs. in 1st 15 minutes | 40 minutes | 8.4 lbs./ 11.6 lbs. wet |
| Proto-type with invention embodiment | 2000 watts | 1.0 lbs. consistently | 60 minutes | 8.4 lbs./ 12.4 lbs. wet |

FIG. 15

HEATING SYSTEM FOR A MACHINE WITH A LIGHT HEAT SOURCE

PRIORITY

This application claims priority to and incorporates by reference in its' entirety, U.S. Provisional Patent Application No. 62/078,777, entitled "System and Method Using a Light Heat Source", and filed Nov. 12, 2014.

TECHNICAL FIELD

The present invention generally relates to heating systems for machines and more particularly to heating systems for machines with a light heat source.

BACKGROUND OF THE INVENTION

Prices for natural gas and electricity have risen over the years, and many consumers desire machines with more energy efficient heat sources. In addition to lowering prices paid for energy, the demand for more energy efficient heat sources is driven by consumers who are worried about conserving finite fossil resources, and lowering carbon emissions.

The EPA and Energy Star have issued new guidelines in June 2014 for a clothes dryer Energy Star certification. Few clothes dryers have achieved this certification. A dryer purchased in 1960 may use the same amount of energy as a current 2014 model, regardless of the make or model. For a dryer to achieve an Energy Star rating, the dryer may be required to reduce current energy use by twenty percent (20%) and the cycle to dry clothes must be no more than 80 minutes on a cycle to dry clothes.

Most current style electric dryers use resistance style/type heating elements with 5000 to 6000 watts at 220 volts. These heating elements may burn bright cherry red at the element itself and heat to a temperature in excess of 2200 degrees F. Most gas dryer work on the same principal by supplying a massive amount of heat (roughly 25000 BTU) to the dryer drum. Both electric and gas dryers may use thermostats to control the temperature inside the drum of the dryer. Many current dryers maintain a drum temperature of around 140 degrees F. The heating element is continually cycled on and off to maintain that optimum temperature inside the drum containing the clothes. The backs of most current dryers have little heat insulation material and a significant amount of heat energy, not utilized in the drying process, is exhausted out. Heated air is not recirculated. Approximately 80% of all dryers manufactured in the United States are electric.

As can be seen, there may be an ongoing need to raise the efficiency of heating sources for machines in general, and electric clothes dryers in specific.

SUMMARY OF THE INVENTION

This summary is provided to introduce a selection of concepts in a simplified form that are further described in the detailed description of the invention. This summary is not intended to identify key or essential inventive concepts of the claimed subject matter, nor is it intended for determining the scope of the claimed subject matter.

In one aspect of the present invention, a heating system for a machine includes a tungsten halogen light bulb, a socket, a heat sink, and a reflector. The tungsten halogen light bulb is configured to emit light when connected to an electric power source. The socket is selectively electrically connected to the electric power source. The tungsten halogen light bulb is removeably connected to the socket. The reflector includes a reflecting surface. The reflector is fixedly mounted in relation to the heat sink, such that the reflecting surface reflects at least a portion of the light onto the heat sink.

In another aspect of the present invention, a clothes dryer includes a drum, an air conduit, an electric power source, at least one heating unit, a heat sink, and a controller. The drum is for placing clothing in to be dried and is configured to rotate. The air conduit is fluidly connected to the drum at a drum end for providing warm air to the drum for drying the clothing. The air conduit includes an interior. The at least one heating unit are fixedly positioned in the interior of the air conduit, and each heating unit includes a reflector including a reflecting surface, a light bulb configured to emit light onto the reflecting surface when connected to the electric power source, and a socket selectively electrically connected to the electric power source. The light bulb is removeably connected to the socket. The heat sink is fixedly mounted in the interior of the air conduit and is positioned such that the reflecting surface reflects at least a portion of the light onto it. The controller is configured to selectively connect the socket to the electric power source.

These and other features, aspects and advantages of the present invention will become better understood with reference to the following drawings, description and claims.

BRIEF DESCRIPTION OF THE DRAWINGS

FIG. 15 is a chart of experimental data comparing an exemplary embodiment of a clothes dryer to competitive clothes dryers.

DETAILED DESCRIPTION OF THE INVENTION

Figure 1:
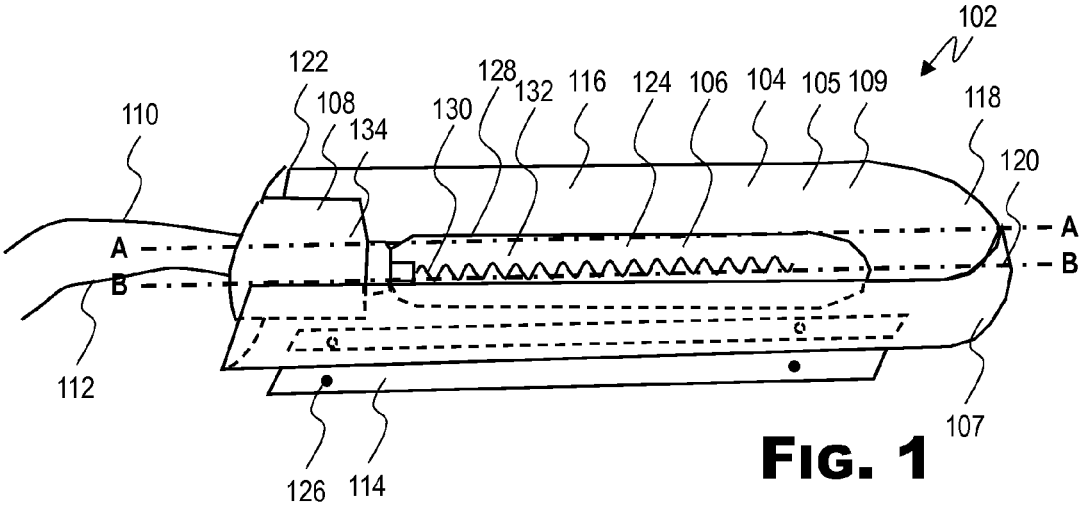
FIG. 1 is a perspective view of a heating unit, according to an exemplary embodiment of the present invention.

The following detailed description is of the best currently contemplated modes of carrying out the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Various inventive features are described using relational terms such as front, back, side, top, and bottom. These terms are used to impart an understanding of spatial relationships between components and elements, views, or other objects, in various embodiments, and are not meant to be limiting.

The heating system illustrated in various exemplary embodiments below, uses light bulbs, and more specifically, in some embodiments, tungsten halogen light bulbs to heat a heat sink. The heat sink may be formed of copper, aluminum, ceramic, metal or gemstone alloys, or other suitable materials. The heating system may be used as a heat source for various household appliances, devices, and/or tools, which currently use natural gas or electrical resistance heat in items such as laundry dryers, hot water heaters, residential furnaces and/or any appliance or device that uses heat energy to heat a media. The heating system uses a new method of focused light energy. Focused light energy is the process of reflecting and/or refracting the energy from the light bulb onto a target heat sink and provides a focal point on that heat sink surface to achieve temperatures that are necessary to accomplish the end design in a much more energy efficient process. By reflecting and/or refracting all the energy from the light and hitting a target on a heat sink, effective temperatures of from 800 to 2000 degrees F. have been achieved in proto-types. The temperatures achieved may be dependent on the distances between the reflectors and/or refractors, the lights bulb, and the heat sink.

The light bulb may be placed into a socket and mounted onto a cuplike reflector that has a reflective material such as polished Aluminum or Aluminum oxide on a reflective surface. The bulb's energy is reflected back onto a target or heat sink material, such as copper, and the heat is transferred into the air or other media for the purpose of heating an object, i.e. air, water or other medium. Other reflective surfaces can be used such as highly polished stainless steel or a brilliant white porcelain coated onto a steel cup. The desired temperatures for the particular application may dictate in part the specific materials used for the heat sink and/or reflector and reflective surface. A copper heat sink may safely can see temperatures of 1800 maybe 1900 degrees safely, as copper's melting point is 1994 degrees F.

The air gap or distance between the reflector and/or refractor and the light bulb, and the distance between the reflector and/or refractor and the heat sink may be designed to achieve the heat output desired within a few degrees. For example, if a temperature of 450 degrees is desired at an x/y location this may be achieved with the heating unit at that precise location, +/−a few degrees, if the environment is stable, with no air currents or outside ambient air infiltration.

Referring now to FIG. 1, an exemplary embodiment of a heating unit 102 is illustrated in a perspective view. The heating unit 102 may include a light bulb 106 configured to emit light when connected to an electric power source 208 (shown in relation to FIG. 11), a socket 108 selectively electrically connected to the electric power source 208, the light bulb 106 removeably connected to the socket 108, and a reflector 104 including a reflecting surface 105.

Although the reflector 104 may take a variety of shapes and sizes, the illustrated embodiment is cup shaped with an exterior surface 107, an interior surface 109, a first end 120, a second end 122, a first side 111, and a second side 113. The first side 111 may be a mirror image of the second side 113 in relation to a longitudinal axis B. The interior surface 109 may be the reflecting surface 105. The reflector 104 may include a body portion 116, and a first end portion 118. The body portion 116 may be a half cylinder shape. The first end potion 118 may be a hollow quarter sphere shape.

The light bulb 106 may be any type light bulb which is capable of emitting sufficient energy for an acceptable life time. Sufficient energy and an acceptable life time may be determined in relation to the particular application the heating unit 102 will be used in. The light bulb 106, may be a tungsten halogen light bulb 124, and include a housing 128 enclosing at least one filament 130, and gas 132. The gas 132 may include a small amount of a halogen such as iodine or bromine. The filament 130 may be a tungsten filament. The combination of the halogen gas 132 and the tungsten filament 130 may produce a halogen cycle chemical reaction which redeposits evaporated tungsten back onto the filament 130, increasing its life and maintaining the clarity of the housing 128 and gas 130. The tungsten halogen light bulb 124 may be operated at a higher temperature than a standard gas-filled light bulb of similar power and operating life, producing light of a higher luminous efficacy and color temperature. Tungsten halogen light bulbs 124 may be commercially available at a reasonable price. Although other light bulbs 106, may be used, a light bulb 106 with high temperature and long life characteristics may provide a better heat source with a longer life.

The light bulb 106 may include a socket end 127 for insertion in the socket 108. The socket end 127 may include helical protrusions for meshing with helical grooves in the socket 108 allowing the light bulb to be removeably connected to the socket 108. When the socket end 127 of the light bulb 106 is fully inserted into the socket 108, the filament 130 may be electrically connected to a positive terminal and a negative terminal within the socket 108 as is known in the art.

Figure 14:
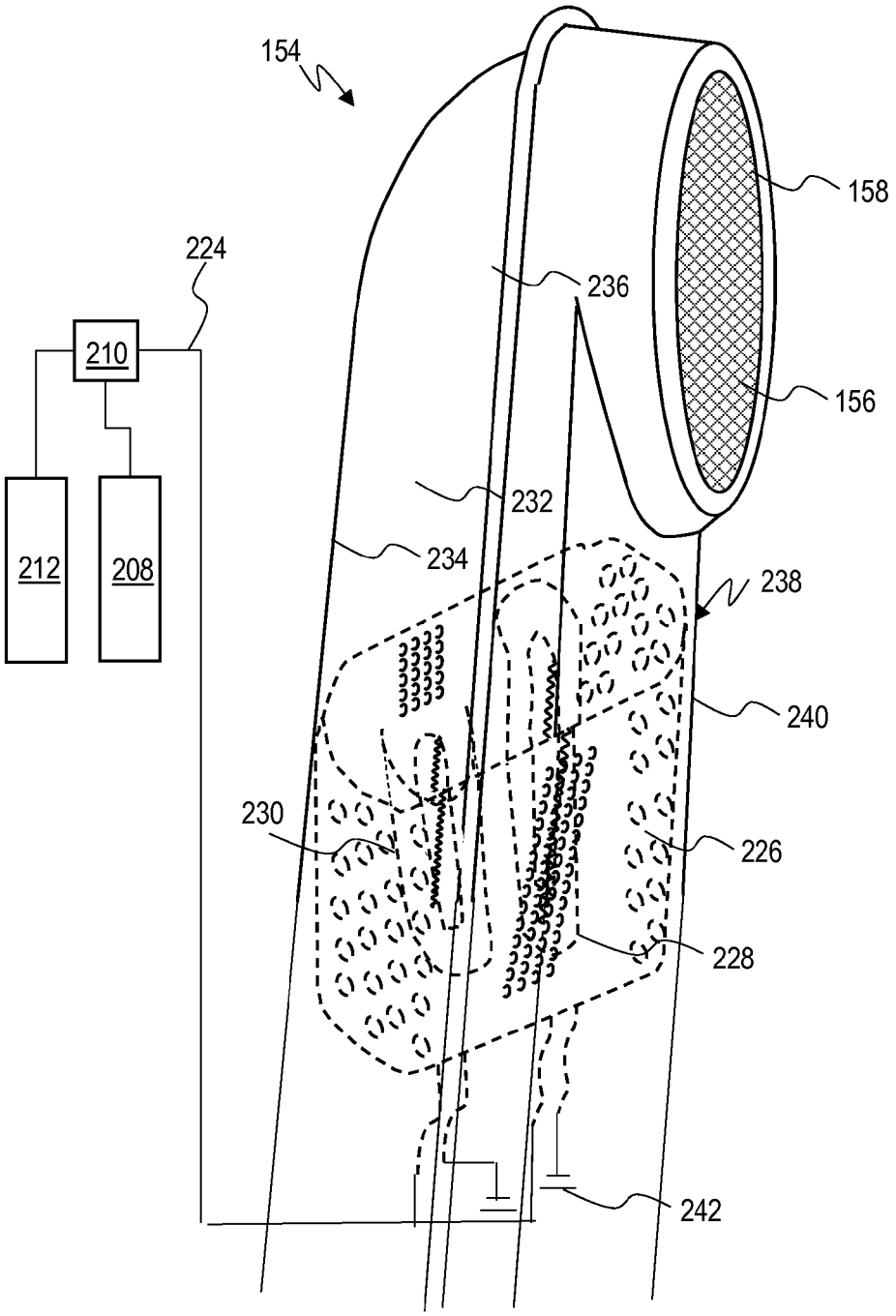
FIG. 14 is a partial side perspective and schematic view of an air conduit, according to another exemplary embodiment of the present invention.

The socket 108 may include a positive electric circuit terminal or wire 110 for connecting with the power source 208, and a negative electric circuit terminal or wire 112 for connecting with a ground 242 (shown in relation to FIG. 14). The socket 108 may include a cavity 136 (shown in relation to FIG. 2) with helical grooves for receiving the socket end 127. The socket 108 may include any receptor device for the light bulb 106 which allows an electrical circuit to be completed when the socket end 127 is fully inserted into the cavity 136, and the positive terminal 110 and the negative terminal 112 are connected to a power source 208 and the ground 242. Although socket ends 127 and sockets 108 with helical protrusions and grooves respectively, as described, are well known and common, other types of connectors are contemplated. The term socket 108, should therefore be interpreted broadly as a connector device which fixedly and removeably connects the light bulb 106 to an electrical circuit; and fixedly and removeably places the light bulb 106 in a desired position relative the reflector 104 and the heat sink 150 (shown in relation to FIGS. 6-10).

The mounting bracket 114 may be fixedly connected to the exterior surface 107 of the reflector 104, for mounting the heating unit 102 in relation to the heat sink 150. The mounting bracket 114 may be welded, riveted, fastened with bolts, or otherwise fixedly connected to the exterior surface 107 in any way known ion the art. In some embodiments the mounting bracket 114 may be an integral portion of the reflector 104. In the illustrated embodiment, the mounting bracket 114 includes apertures 126 for mounting the heating unit 102 with bolts. However, in other embodiments the mounting bracket may be fixedly connected to another surface in any way known in the art to mount the heating unit 102.

Figure 2:
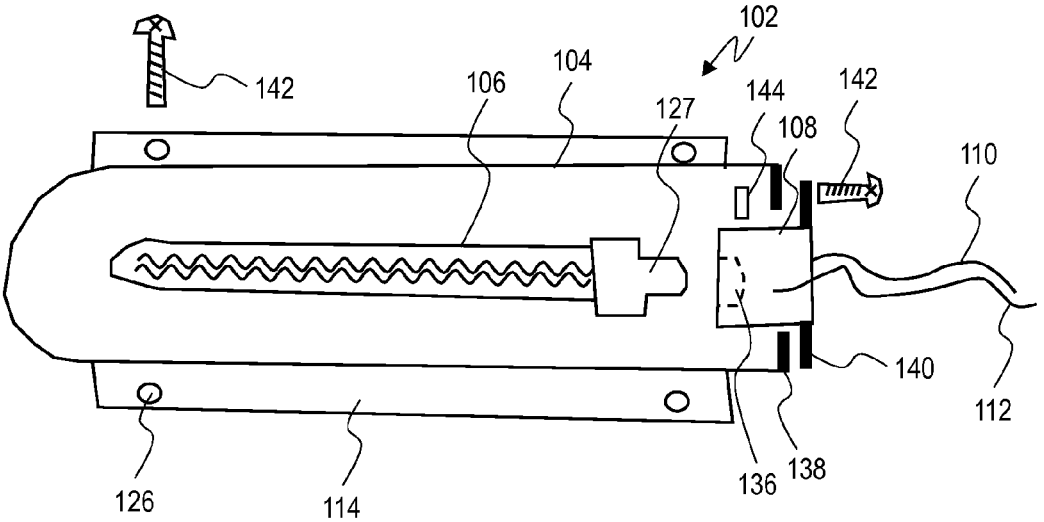
FIG. 2 is a top expanded view of a heating unit, according to an exemplary embodiment of the present invention.

Referring now to FIG. 2, a top expanded view of the heating unit 102 is illustrated. In the embodiment illustrated, the reflector 104 includes a reflector mounting flange 138, and the socket 108 includes a socket mounting flange 140 for fixedly mounting the reflector 104 to the socket 108. In other embodiments, other forms of connecting the reflector 104, the socket 108, and the light bulb 106 in desired relational positions may be used. The reflector mounting flange 138 and the socket mounting flange 140 may be fastened together with bolts 142 and nuts 144, or other connection means known in the art.

Figure 3:
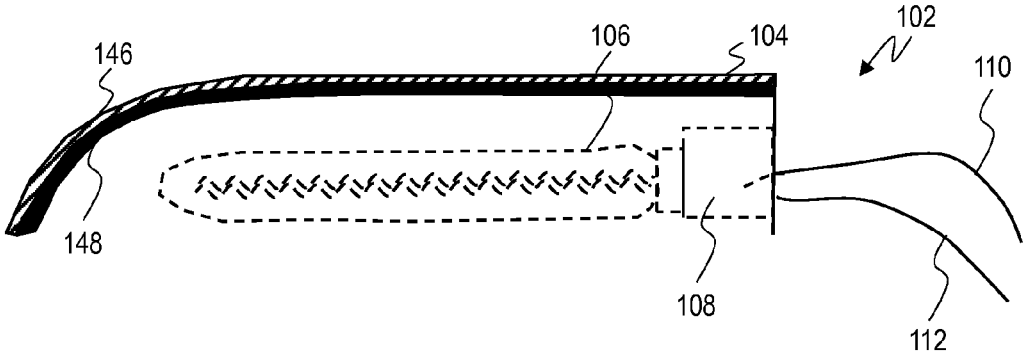
FIG. 3 is a cross sectional view of a heating unit along line A in FIG. 1, according to an exemplary embodiment of the present invention.

Referring now to FIG. 3, a cross sectional view of the heating unit 102, along line A in FIG. 1, is illustrated. The reflector 104 may be made of aluminum, another metal, a metal alloy, or a ceramic. If the reflector 104 is made of a metal or metal alloy, the reflecting surface 105 may be the same metal, but polished, and in some cases highly polished. In some embodiments however, the reflector 104 may include a reflector base 146 which may be made of aluminum, copper, another metal, a metal alloy, a ceramic, or any other solid material which has the heat and solidity characteristics needed for the heat unit 102 in the particular application. The reflector 104 may also include a reflector coating 148 which may be a white overlay such as porcelain or aluminum oxide which may have the reflection properties, or be polished to have the reflective properties needed for the particular application the heating unit 102 will be used in. Other coatings, as known in the art, may also be used.

Figure 4:
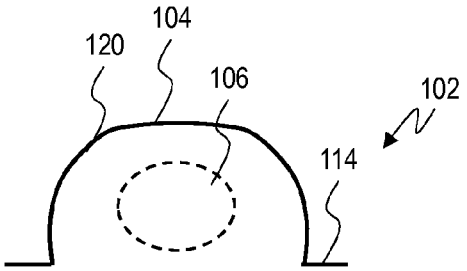
FIG. 4 is a first end view of a heating unit, according to an exemplary embodiment of the present invention.
Figure 5:
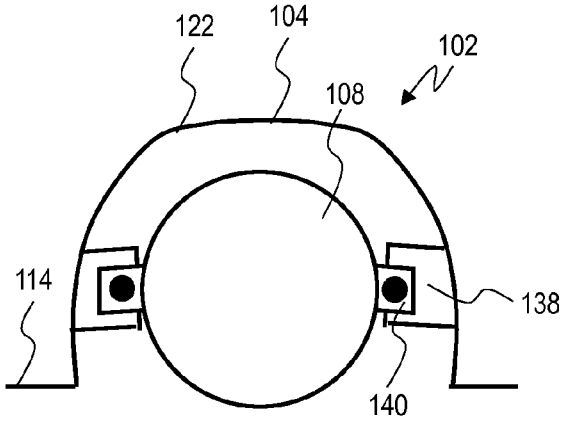
FIG. 5 is a second end view of a heating unit, according to an exemplary embodiment of the present invention.

Referring now to FIG. 4 and FIG. 5, a first end 120 view of the heating unit 102, and a second end 122 view of the heating unit 102 are illustrated respectively.

Referring now to FIGS. 6-10, several different embodiments of a heating system 100 are illustrated. The heating system 100 includes the heating unit 102 and a heat sink 150. The reflector 104 is fixedly mounted in relation to the heat sink 102, such that the reflecting surface 105 reflects at least a portion of the light emitted by the light bulb 106 onto the heat sink 150. Several exemplary embodiments of heat sinks 150 are illustrated in FIGS. 6-10, but they should be considered non-limiting. In general, the heat sink 150 may include any device which may absorb and dissipate into a media heat radiated from the light bulb 106. The heat sink 150 may include devices of various shapes and materials and may be designed to dissipate the desired heat of a particular application the heating system 100 is being utilized in.

Figure 6:
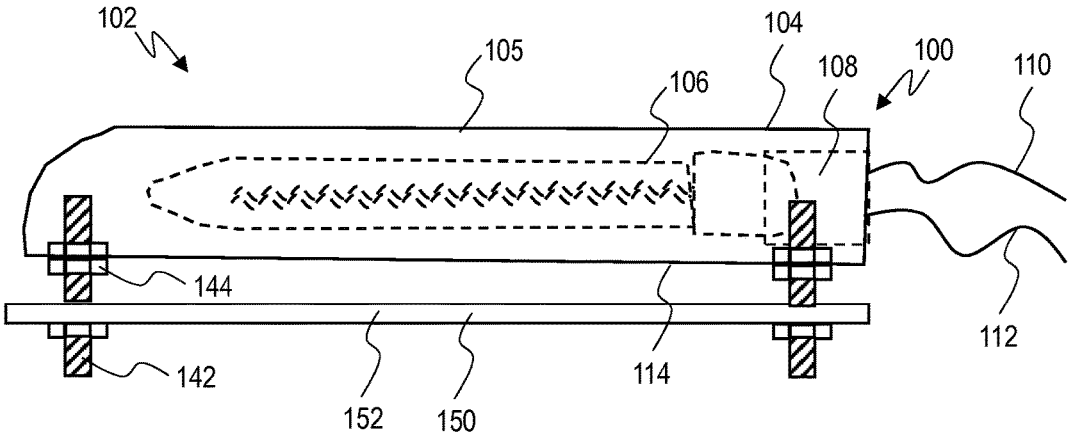
FIG. 6 is a side view of a heating system, according to an exemplary embodiment of the present invention.

FIG. 6 illustrates an exemplary embodiment of the heating system 100, with a plate heat sink 152. The plate heat sink 152 may be fixedly attached to the mounting bracket 114 with bolts 142 and nuts 144, or in another way as known in the art. Light energy from the light bulb 106 may be reflected by the reflective surface 105 onto the plate heat sink 152. The plate heat sink may absorb the light energy, and dissipate it in a media, such as air, which the plate heat sink 152 is in thermal contact with.

Figure 7:
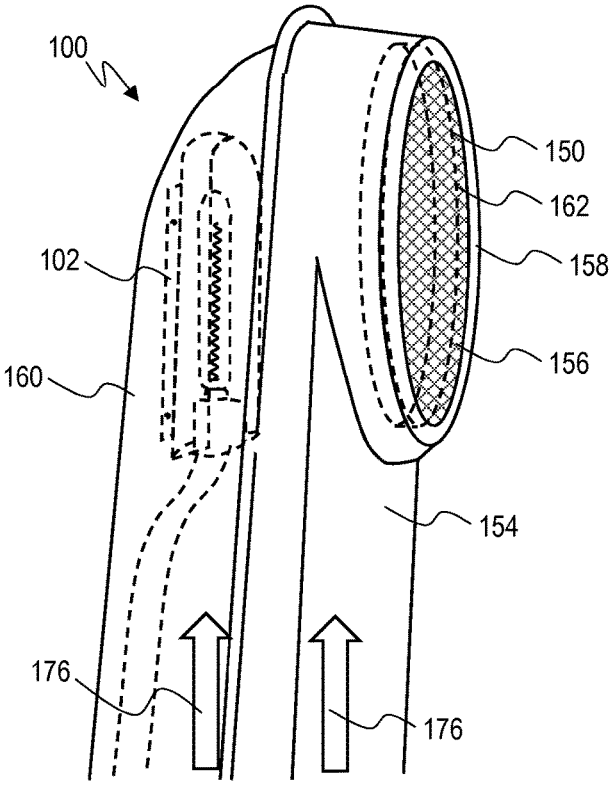
FIG. 7 is a side perspective view of an air conduit, according to an exemplary embodiment of the present invention.
Figure 8:
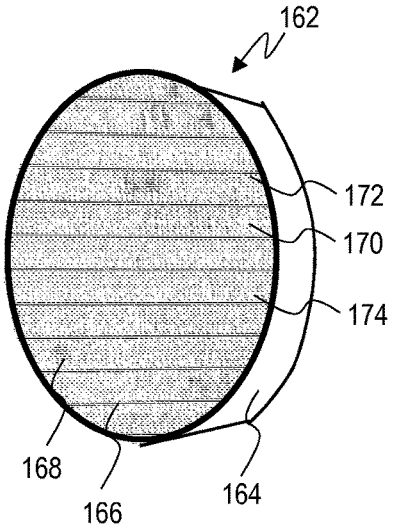
FIG. 8 is a front perspective view of a heat sink, according to an exemplary embodiment of the present invention.

FIGS. 7 and 8 illustrates an exemplary embodiment of the heating system 100, with a porous heat sink 162. Illustrated in FIG. 7 is a side perspective view of an air conduit 154. The air conduit 154 may, for example, be an air conduit 154 in a clothes dryer 200 (shown in relation to FIG. 11). The air conduit 154 may include a drum end 158, with a vent 156, and an interior surface 160. At least one heating unit 102 may be fixedly mounted to the interior surface 160. The porous heat sink 162 may be mounted at the drum end 158, in such a manner that the reflective surface 105 reflects light energy from the light bulb onto the porous heat sink 162. Air flow, illustrated as arrows 176, may flow through the air conduit 154, past the at least one heating unit 102, through the porous heat sink 162, out the vent 156 and into a drum 202 (shown in relation to FIGS. 11 and 13) of the clothes dryer 200. As the air passes through and/or comes in thermal contact with the porous heat sink 162, heat is transferred from the porous heat sink 162 to the air.

As illustrated in a front perspective view of a porous heat sink 162 in FIG. 8, one embodiment of the porous heat sink 162 may include a housing 164 with a porous member 166. The porous member 166 may include a metal mesh 168. The metal mesh 168 may include channels 170 through which the air flows. The channels 170 may be formed by cross members 172, with fins 174 between the cross members 172. The channels 170 allow the air to come into thermal contact with a larger surface area of the heat sink 150. Other embodiments of the metal mesh 168 may include, for example, a steel wool type structure, or any other mesh which allows for an increased surface area of the heat sink 150 to come into contact with the air.

Figure 9:
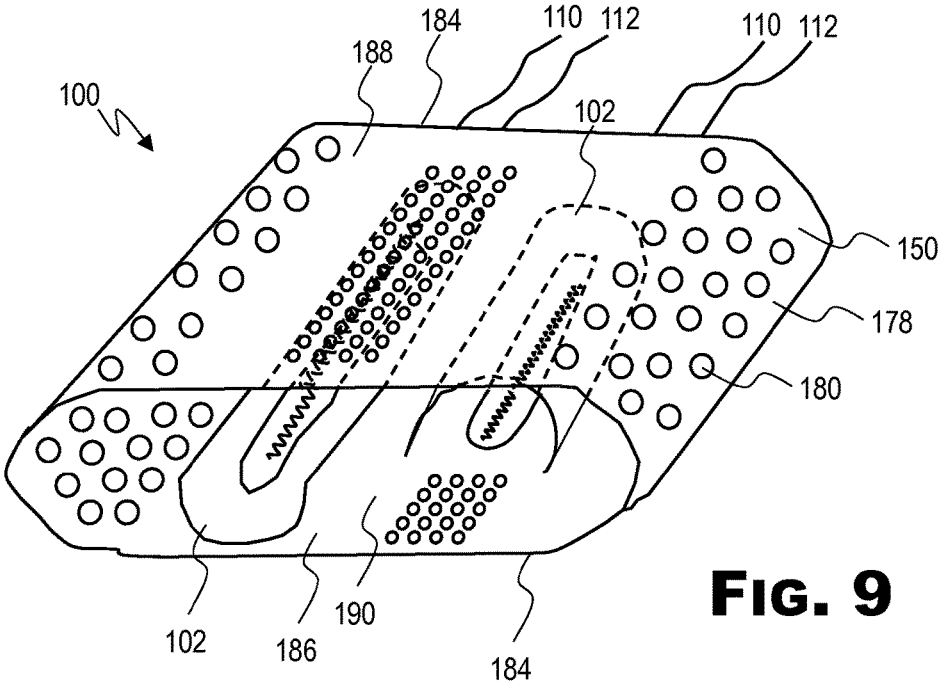
FIG. 9 is a top perspective view of a heating system, according to an exemplary embodiment of the present invention.

FIG. 9 illustrates a top perspective view of a heating system 100 with a housing heat sink 178. The housing heat sink 178 may be a hollow member formed from sheet metal or another material with two open ends 184, an interior surface 186, an exterior surface 188, and an interior 190. At least one heating unit 102 may be mounted on the interior surface 186. The interior surface 186, or a portion of the interior surface 186 may also be an additional reflective surface 105. The housing heat sink 178 may include apertures 180, which may be of a variety of sizes and shapes. The apertures 180 may increase flow of a media (air or another media) through and around the housing heat sink 178, and increase heat transfer to the media. The heating system 100 with the housing heat sink 178 may be mounted such that a media, to which it is desired to transfer heat, flows around and through the heating system 100.

Figure 10:
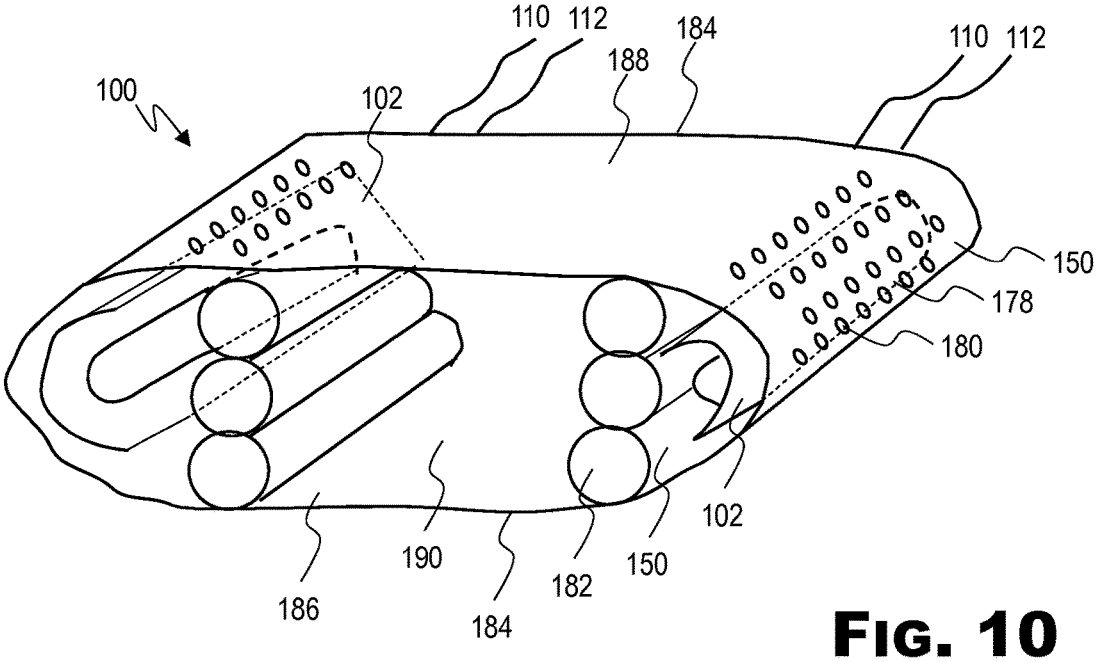
FIG. 10 is a front perspective view of a heating system, according to an exemplary embodiment of the present invention.

FIG. 10 illustrates a front perspective view of a heating system 100 with a housing heat sink 178 and at least one rod heat sinks 182. The housing heat sink 178 is similar to and functions similar to the one illustrated in FIG. 9, with the addition of rod heat sinks 182 mounted in the interior of the housing heat sink 178. The additional rod heat sinks 182 may increase heat retention and transfer.

The heat sink 150 may be formed of a variety of materials depending on the application specifications, commercial pricing at the time of manufacture, and other factors known in the art. Non-limiting examples of materials which may be suitable for some or all applications include gold, silver, copper, aluminum, diamonds, composite materials, aluminum alloys, and silica or sand held in a matrix or alloy. The cost and low melting point of gold may limit its' usefulness. The cost of silver may be a limiting factor, but silver does have excellent heat sink and reflective properties. However silver also tarnishes quickly making its reflectiveness hard to achieve without continual polishing. Copper is an excellent heat sink, and has excellent conductivity, however high cost may be a limiting factor. Aluminum has good heat sink properties, good conductivity, low cost, is easily cast and molded into a variety of shapes, and is easily alloyed with other metals such as copper. Diamonds have thermal conductivity which is five times that of copper, however at this time they are very expensive so cost may be a limiting factor. Man-made diamonds in alloyed metal such as dymalloy are a possible material for lower cost. Composite materials include are copper-tungsten pseudoalloy, silicon carbide in aluminum, dymalloy, silicon alloy mixture, and beryllium oxide. Aluminum alloys include the 1000 through 7000 series and any variant thereof.

Figure 11:
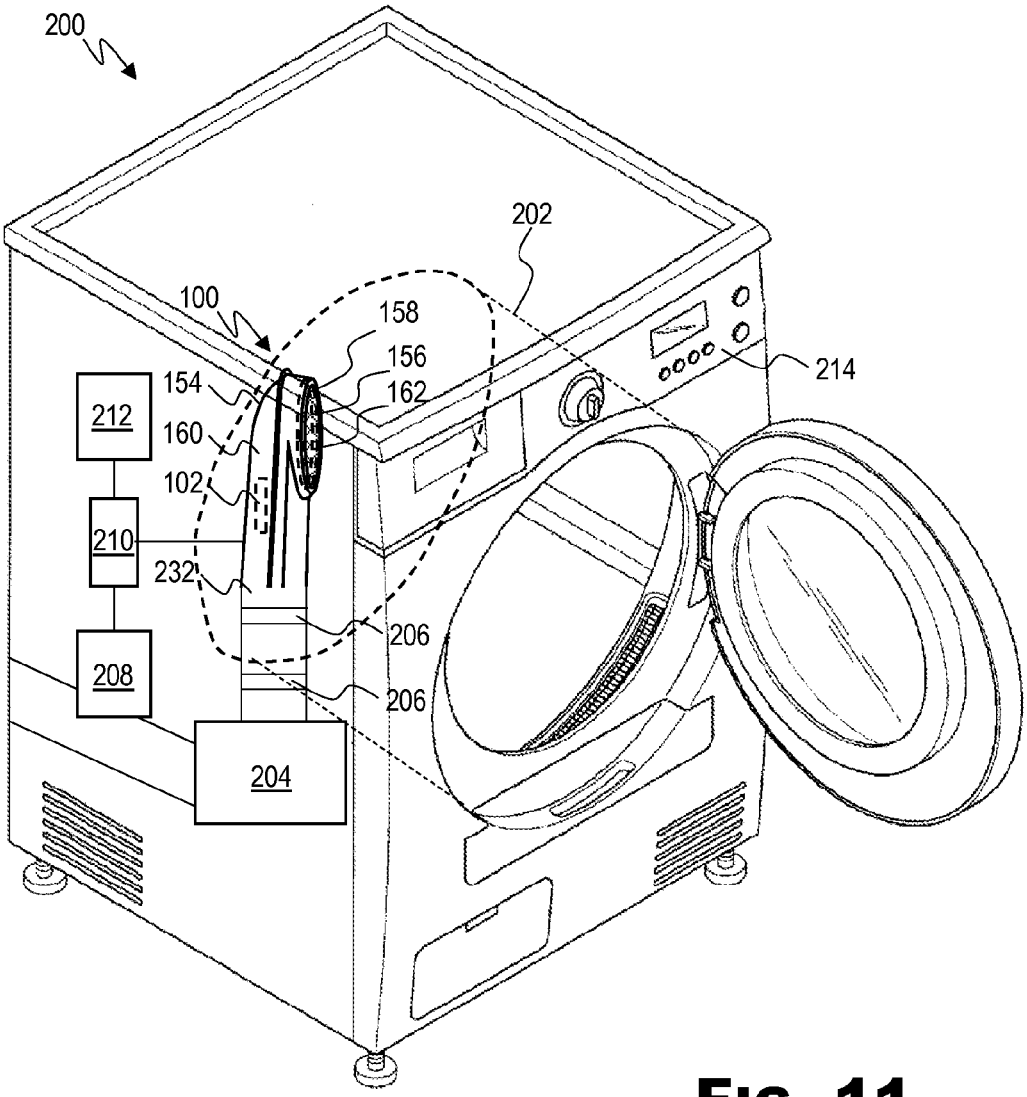
FIG. 11 is a perspective and schematic view of a clothes dryer, according to an exemplary embodiment of the present invention.

Referring now to FIG. 11, a perspective and schematic view of an exemplary clothes dryer 200 with the heating system 100 is illustrated. The clothes dryer 200 may include the drum 202, the air conduit 154 including an air conduit interior 232 fluidly connected to the drum 202 at the drum end 158, the electric power source 208, at least one heating unit 102 fixedly positioned in the air conduit interior 232, the heat sink 150 fixedly mounted in the air conduit interior and positioned such that the reflecting surface 105 reflects at least a portion of the light onto the heat sink 150, and a controller 212 configured to selectively connect the socket 108 to the electric power source 208. The drum 202 is configured to rotate, and for placing clothing to be dried. The air conduit 154 may provide warm air to the drum 202 for drying the clothing.

The drum 202 may rotate while heated air is pumped through it as is known in the art. A fan 204, or other air flow device, may cause air flow through the air conduit 154, which may be heated by the heating system 100, and flow into the drum 202 through the vent 156 in the drum end 158. At least one heating unit 102 may be mounted on the interior surface 160, and the porous heat sink 162 may be mounted between the heating unit 102 and the vent 156. In some embodiments, it may be necessary to slow the flow of air through the air conduit 154 so that the air is heated to a desired temperature before entering the drum.

For example, the heating system 100 may be part of a retro-fit kit which is installed in the clothes dryer 200 after manufacture and/or sale, and replaces a more traditional system—such as a gas heater or an electric resistive element heater. The clothes dryer 200 may include at least one interference member 206 (two interference members 206 are illustrated) to slow the air flow through the air conduit. The interference members 206 may include a housing 164 and a porous member 166 similar to the porous heat sink 162 illustrated in FIG. 8. In other embodiments the interference member(s) 206 may be any device known in the art which slows the flow of air through the air conduit 154.

Figure 12:
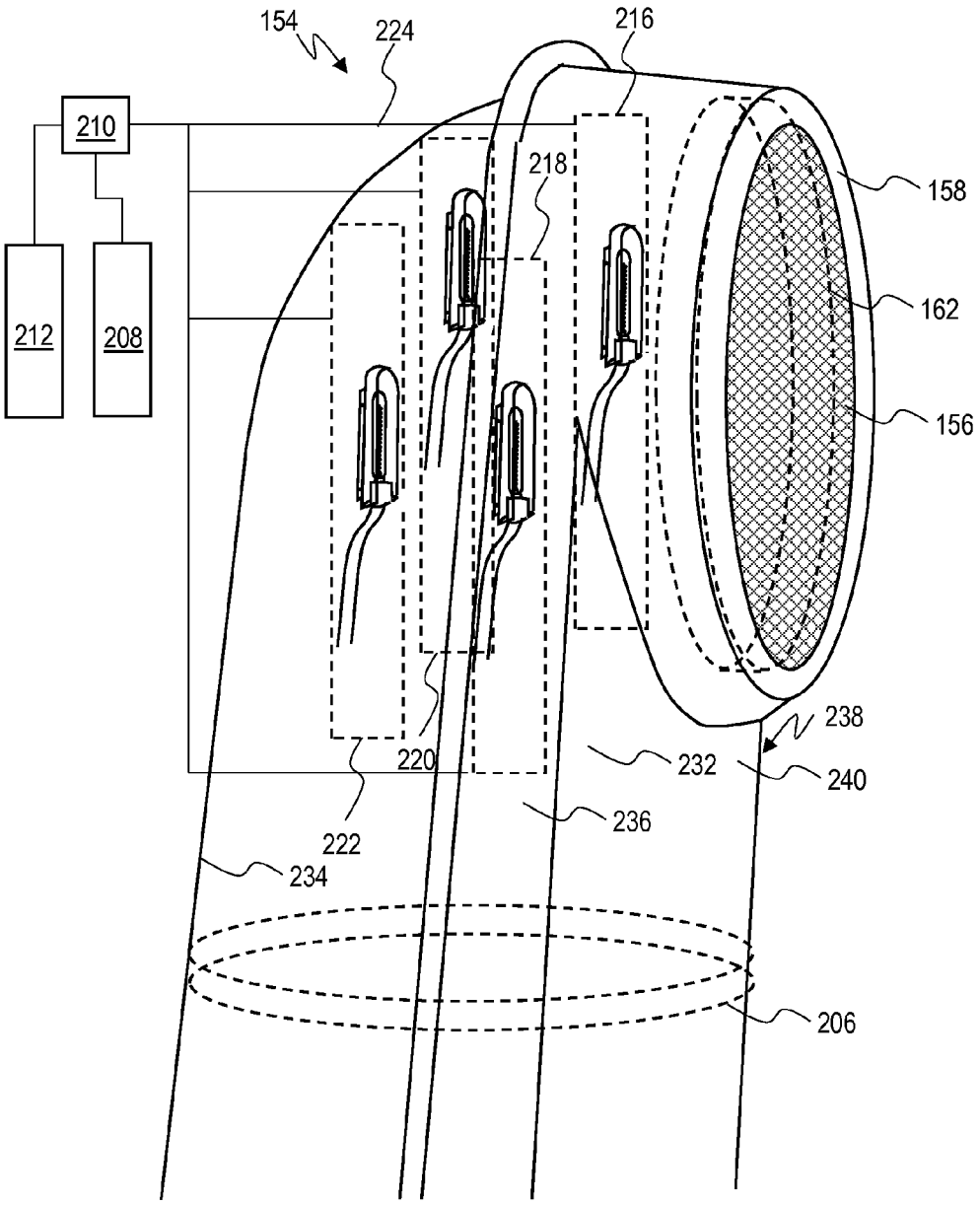
FIG. 12 is a partial side perspective and schematic view of an air conduit, according to an exemplary embodiment of the present invention.

The clothes dryer 200 may include a user interface 214 through which a user can enter desired commands such as on/off commands, cycle commands, timer commands, and/or heat commands as is known in the art. The controller 212 may be communicatively connected to the user interface 214 to receive signals indicative of the desired commands, as is known in the art. The controller 212 may be communicatively connected to a switch 210 to actuate the switch 210 to selectively connect the at least one heating unit 102 to the power source 208 as needed to fulfill the commands entered by the user. The controller 212 may be software based and include one or more processors and one or more memory units. In other embodiments, the controller 212 may be a hardware control, or the controller 212 may be a combination of software and hardware. Although shown as separate units, the controller 212, switch 210, and/or power source 208 may be combined into one or more units. Referring now to FIG. 12, a partial side perspective and schematic view of an exemplary embodiment of the air conduit 154 of FIG. 11 is illustrated. Schematic representations of heat units 102 are used which are not necessarily to scale. The air conduit 154 may have an interior back wall 234, an interior first side wall 236, and interior second side wall 238, and an air conduit front 240. A first heating unit 216 may be mounted on the first side wall 236, a second heating unit may be mounted on the second side wall 238, and a third heating unit 220 and a fourth heating unit 222 may be mounted on the back wall 234. All the heating units 102 may be selectively electrically connected to the power source 208 through electrical connectors 224.

Figure 13:
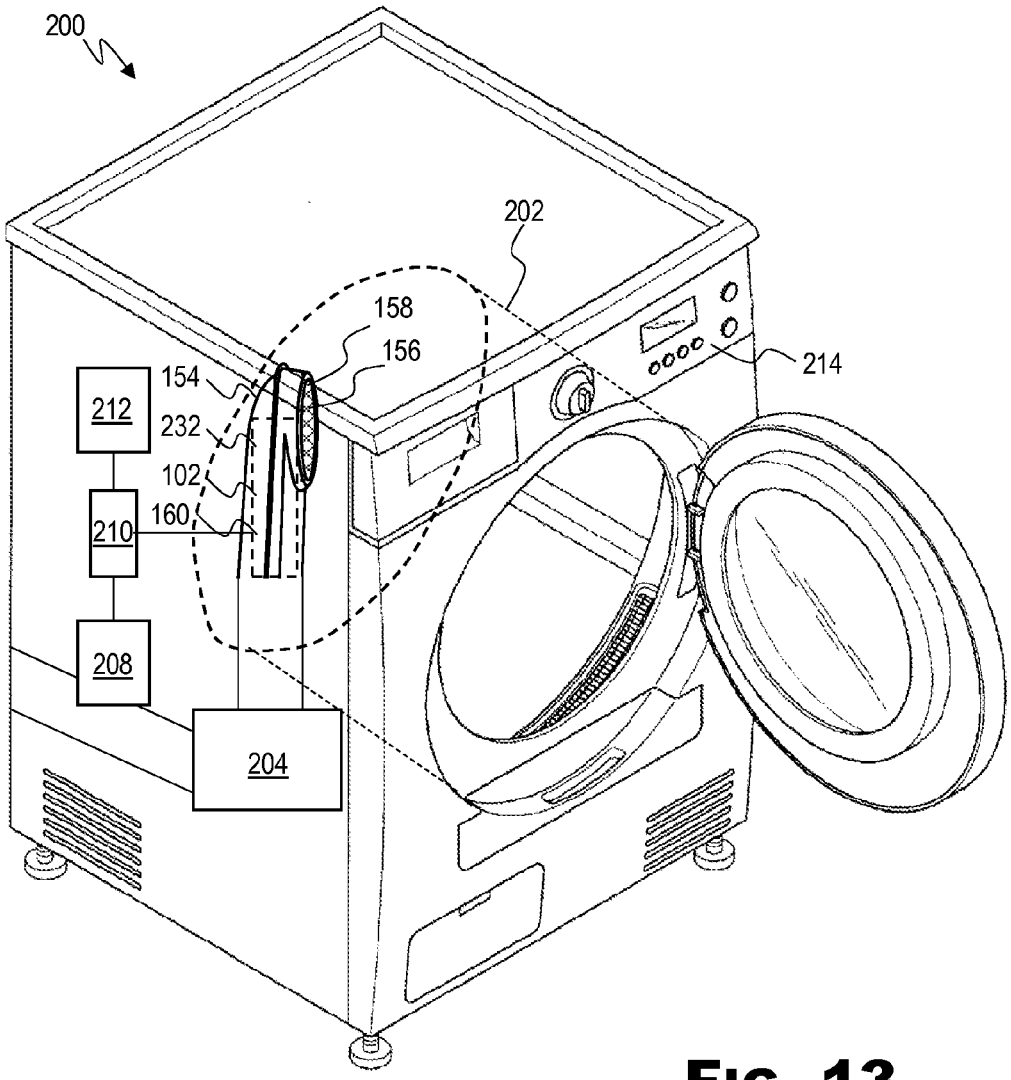
FIG. 13 is a perspective and schematic view of a clothes dryer, according to another exemplary embodiment of the present invention.

Referring now to FIG. 13, a perspective and schematic view of another embodiment of the clothes dryer 200 is illustrated. In this embodiment, the heat sink 150 is a housing heat sink 178, and a housing heating unit assembly 226 is mounted in the air conduit interior 232. Other elements other than the heating system 100 embodiment are similar to the clothes dryer 200 of FIG. 11 and will not be further described.

Referring now to FIG. 14, a partial side perspective and schematic view of an exemplary embodiment of the air conduit 154 of FIG. 13 is illustrated. Schematic representations of heat system 100 is used which is not necessarily to scale. The housing heating unit assembly 226 includes the housing heat sink 178. A fifth heating unit 228 and a sixth heating unit 230 may be mounted on the interior surface of the housing heat sink 178. All the heating units 102 may be selectively electrically connected to the power source 208 and grounds 242 through electrical connectors 224.

Referring now to FIG. 15, a chart of experimental data comparing an exemplary embodiment of the clothes dryer 200 to competitive clothes dryers is illustrated. Wattage was calculated by taking incoming voltage times the amperage load—Ex: 122V×16.7 A=2037. The washer used to conduct all testing with the prototype dryer added four pounds to the water weight of the test load. The washers used when testing the commercially available dryers added only three pounds of water weight to the test load. The prototype dryer may dry the same test load in forty-five minutes if a washer adding only three pounds of water weight were used. Washer 1, with the washer adding only three pounds of water weight, was the most energy efficient of all the comparison tests, combining the lesser water weight and a modulating dryer. On the maximum dryer setting it will dried the test load in forty minutes but used the maximum wattage of 4758. Washer 1 was not consistent at removing the same water weight every fifteen minute check, which may have been due to its higher modulating rate (it turns the heating unit off for a longer period of time). At the thirty minute check interval it removed five tenths of a pound of water weight in a fifteen minute period, compared to its initial one and three tenths pounds in a fifteen minute period at start-up. The prototype dryer consistently removed one pound of water weight at every fifteen minute weigh check.

In another test, a prototype dryer dried clothes in the same time period as a gas dryer. The same test set of laundry was used and took fifty to sixty minutes to dry in a gas dryer and the same set of clothes took forty-seven to fifty-five minutes to dry in the prototype consistently. The prototype dryer ran with a consistent temperature during the entire drying process and did not cycle on and off. The gas dryer did cycle on at a temperature of 120 degrees and cycled off at about 150 degrees by design. The fact that the prototype never cycled may be the reason it could achieve a few minutes better time. This new process achieves a far greater energy reduction than the EPA and Energy Star has set forth in their goals, as well as exceeding the time limit of 80 minutes or less. Each heating unit in the new process can be designed specifically for the individual appliance being retrofit with little to no manufacturer retooling or redesign of the basic appliance.

The heat gun has been available for home owners to scrape paint off the wall, and has also been available in the industrial area for various purposes from heat shrinking protective wire wraps for electrical use to curing glues in a timely manner. There are many styles and types of heat guns on the market today. They range in price from thirty dollars all the way into the thousands of dollars depending on the application. They may the range in temperatures from 0 to 1000 degrees. The one thing in common they all have is that they need a lot of energy to perform these tasks because of the method of heating employed. Some guns are 230 volts and some are 115 but they all draw quite a bit of power in order to perform at a peak level The embodiments of heat gun with the heating system 100 described below may not require as much power power and may use substantially less electricity to perform the same tasks and more.

In addition to being more cost effective, the heat guns with the heating system 100 described below may perform additional tasks the standard industrial heat gun does not. For example, many serious home mechanics/hobbyists have a collection of tools in their home and/or shop that allow them to fix everything from repairing that bent blade on the lawnmower to replacing the hot water heater. The heat guns with the heating system 100 described below may switch from stripping paint, to sweating a new fitting, to heat shrinking plastic over the windows for those in colder climates, to welding that plastic fitting on abs pipe assuring there are no leaks.

After sweating fittings together, there can sometimes still be a leak in the fitting. The reason for the leak may be incorrect or uneven heat distribution around all 360 degrees of the fitting. The heat gun with the heating system 100 described below may provide more even heat all the way around eliminating the danger of catching anything on fire, while sweating the joints together. The process may be performed as quickly, or faster, than a torch without the danger that an open flame can cause.

The heat gun may comprise a main body and three (or more in the future) detachable heads that perform different operations. One head may be for sweating common household sizes of copper piping which are ¼ inch and ¾ inch pipe, although larger sizes are contemplated as part of the invention. Another head may function as a heat gun. Another head may be utilized as a heavy duty-soldering gun. These heads may be mounted to the body in a quick disconnect fashion, perhaps like Black and Decker's Firestorm® system. A prototype of this is already in existence and is proven to work.

Figure 16:
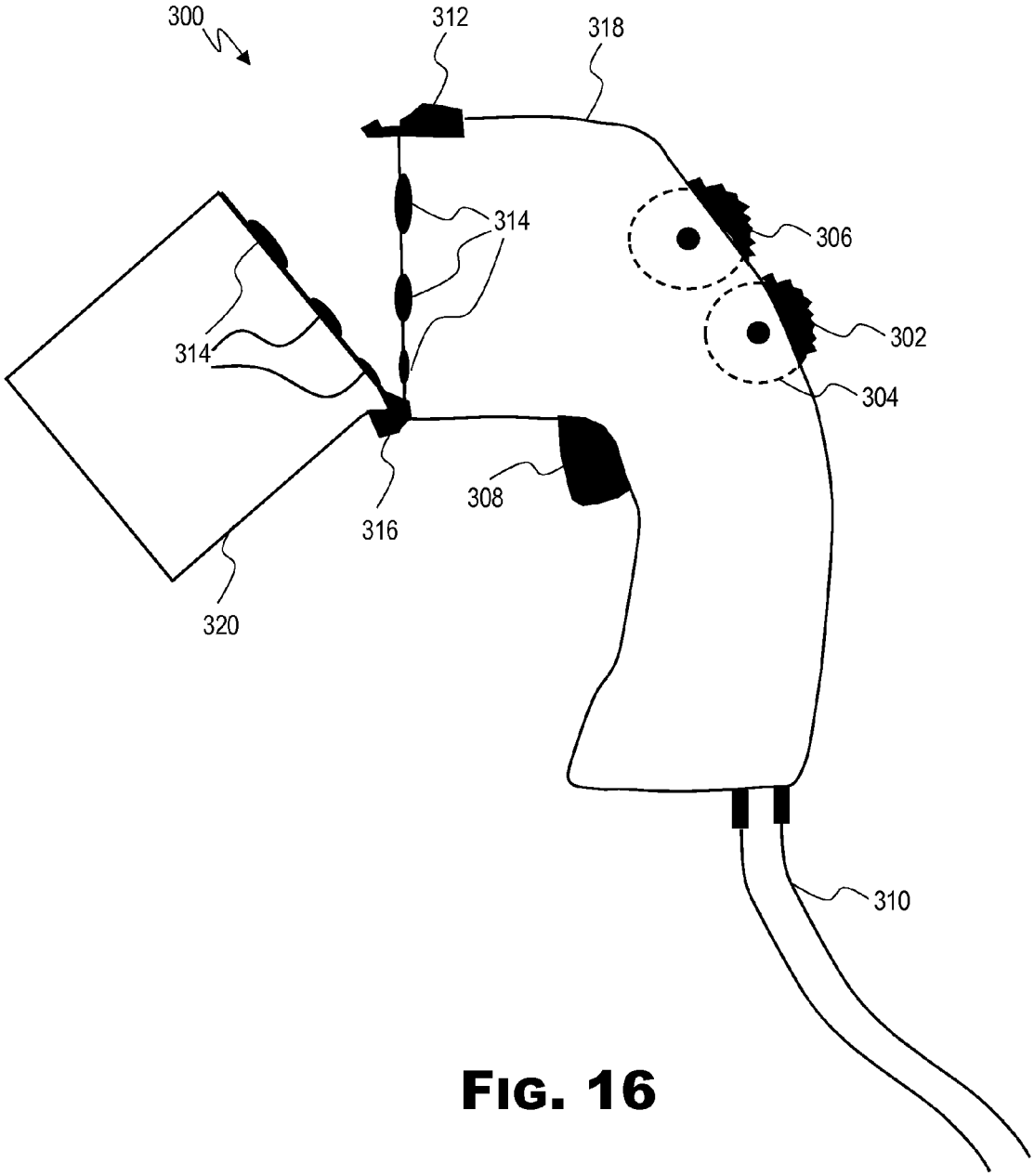
FIG. 16 is a side view of a heat gun, according to an exemplary embodiment of the invention.

Referring now to FIG. 16, a side view of a heat gun 300, according to an exemplary embodiment of the invention is illustrated. The heat gun 300 may include a body 318 rotably connected to a head 320 with a heavy-duty hinge 316. The body 318 can be made from molded plastic and the head 320 can be made from cast aluminum with a coating of aluminum oxide on the inside of the head providing the reflective quality. Other suitable materials as known ion the art may also be used. A simple pistol-grip design with a pull trigger on-off power switch 308, and a rheostat switch 302 mounted to the side of the body 318 casing may be used. The rheostat switch 302 may be pre-marked at certain settings for particular temperatures. For example setting one may be equivalent to 500 degrees. The heat gun 300 may also include a fan switch 306 for controlling the fan 344 (shown in relation to FIG. 18A), electrical contacts 314 for transferring electric power from the body 318 to the head 320, and a latch 312 for fixedly connecting the head 320 to the body 318. An electric cord 310 may provide power to the heat gun 300.

Each head 320 may require a different configuration because each head 320 may do a separate task. For example, the heat gun head 320 may be different from the head 320 that sweats copper piping. Each head 320 may incorporate a quick disconnect style system so that the operator can quickly disconnect one head 320 from the body 318 and quickly replace it with another head 320 to the body 318 to perform a completely separate task.

Referring to FIG. 2, each individual head will perform different tasks. The first head design will sweat copper pipe joints together The standard method for doing copper plumbing work and sweating joints together is to use mapp gas or propane in a handheld torch configuration The problems with this method include annoying possibility of running out of gas before you have completed the job without any spare cylinders handy. Even with plenty of gas, after heating the joint a half dozen times, when you finally think you have the solder all around the joint, you shut the torch off, turn the water back on, and may then discover that on the backside of that joint has a leak because you the flame had not heated the joint evenly around. The proposed device will solve both problems. The illustrated head is designed to clamp around the pipe and heat both the top and bottom of the joint at the same time. When the operator pulls the trigger, 1300 degrees of heat hits the piping. The process includes clamping the gun onto the coupling, pulling the trigger, in a few seconds applying the solder, and removing the gun The head may be made from cast aluminum with the inside surface being coated multiple times with aluminum oxide, thus giving the inside of the unit a reflective quality. The head may be divided into two halves—an upper half and a lower half. This will enable the head to clamshell together and lock onto the pipe. A set of dies may be used that attach to the head at the clamshell that will fit ½ inch and ¾ inch pipe also a 1-inch die should be available. Two bulbs will be used that stay with the head, one on top, and one on the lower jaw.

Figure 17:
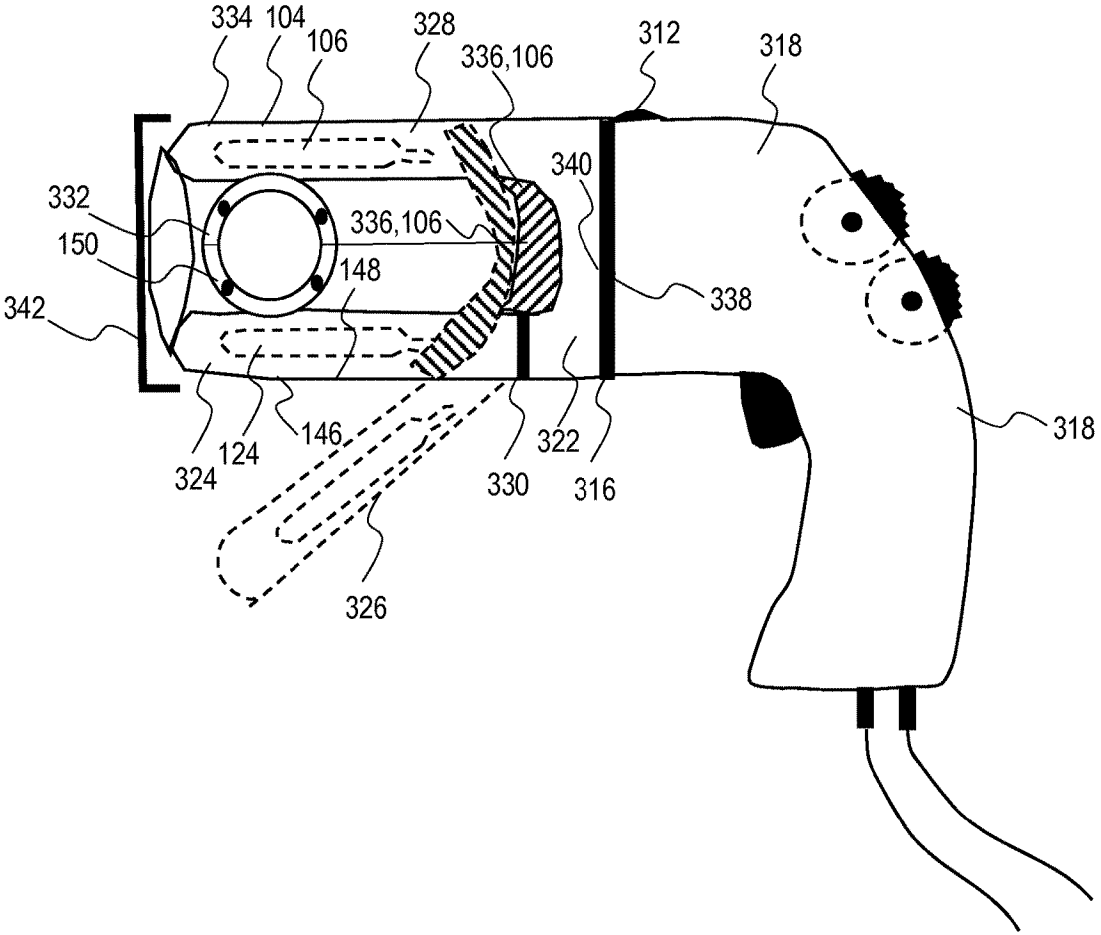
FIG. 17 is a side view of a heat gun, according to another exemplary embodiment of the invention.

Referring now to FIG. 17, a side view of a heat gun 300 wherein the head 320 is a sweating head 322 is illustrated. The sweating head 322 is cylindrical in shape and the lower portion 326 of the jaw 324 is rotably connected with a jaw hinge 330 to drop down out of the way so it may the attach to the pipe that is to be sweat together. Once the jaw 324 is opened, the head 322 may be inserted onto the pipe and the pipe set into dies 332 which also may split in half. One half of the die 332 is mounted onto an upper portion 328 of the jaw 324 and the other half mounted onto the lower portion 326. The dies 332 may be mounted to the jaw 324 sections with two screws, each screw spaced evenly between each die 332.

The sweating head 322 may come with several sets of dies 332, each set made for different size pipe couplings.

Two light bulbs 106 may be mounted inside each jaw portion 326, 328, with each on the centerline. On the inside of where each bulb 106 is located, the jaw 324 may have a concave surface 334 with a coating of aluminum oxide. The aluminum oxide may be mixed into a paste and applied to the concave surface 334. When it cures, it may be a hard white coating that will reflect the light from the light bulb 106 back onto the pipe. At the backend of each light bulb 106 there may be a highly polished stainless steel reflector 336, set on an angle, to reflect the light forward towards the pipe.

Since the sweating head 322 may comprise a good percentage of the physical weight of the entire gun 300, a heavy duty cam style hinge 316 may be utilized to rotably connect the head 320 with the body 318. When the head 320 swings up into place it may slip into a heavy catch/release 312 located on top of the body 320. When the head 320 is secured to the body 318, a body contact wall 338 may make a connection to a head contact wall 340. These walls 338, 340 may have the electrical contacts 314 permanently mounted to each wall 338, 340 to align up to the respective opposite wall and provide the electrical contact to power the accessories mounted in the head 320 such as the light bulbs 106, or anything else that would be mounted to the head 320.

The head 320 may be completely sealed by the use of a removable end cap 342 which may slip snugly over the entire end of the head 320, giving the operator greater safety while using this tool. The end cap 342 may also be tethered to the head 320 in some fashion. The head 320 may be made, especially around the bulbs 106 in layers. Going from the light bulbs 106 outward, the first layer may be the aluminum oxide, the second layer may be the cast aluminum and, the third layer may be heat repelling insulation, and the final layer may be a composite or like material such as sheet metal. This would give the operator extra protection against injury.

Figure 18A:
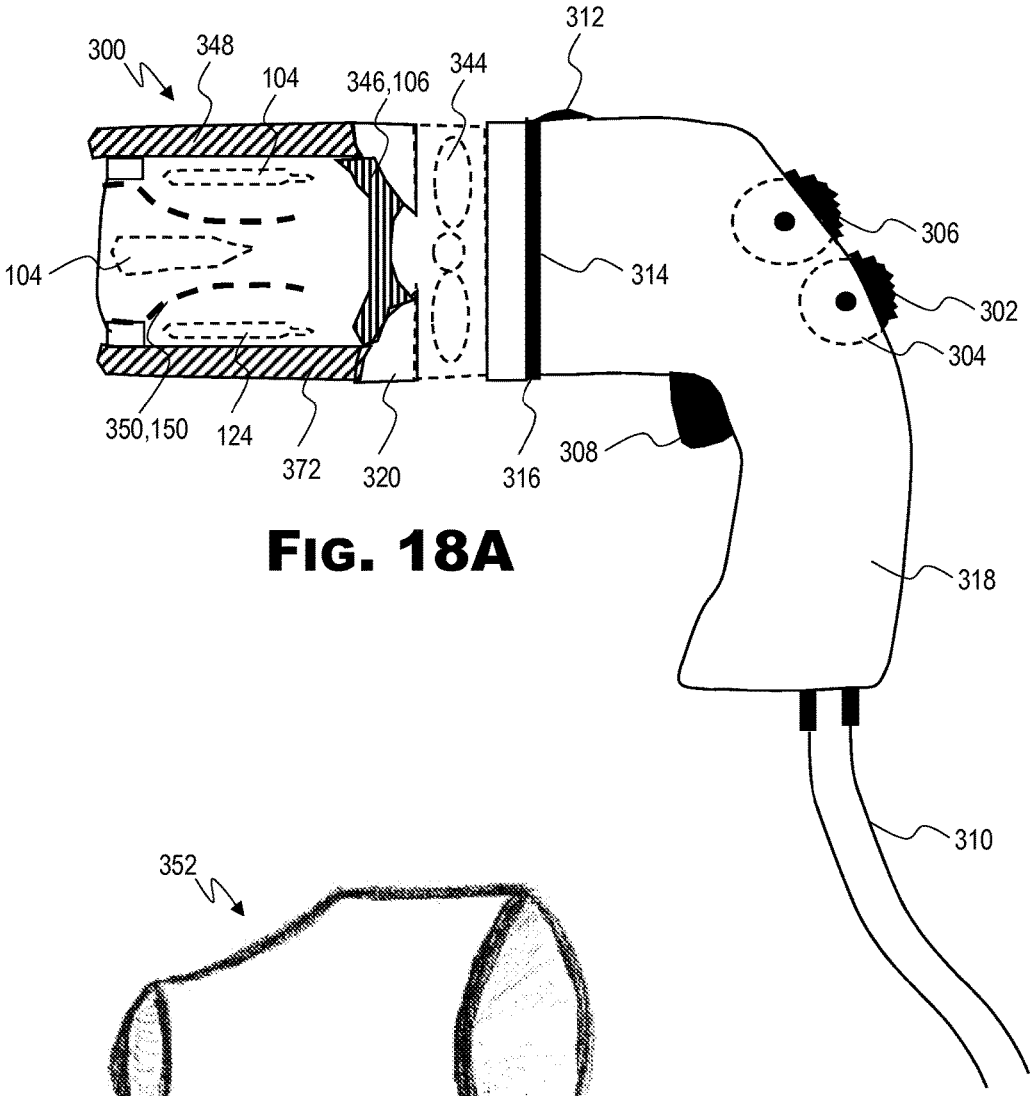
FIG. 18A is a side view of a heat gun, according to another exemplary embodiment of the invention.

Referring now to FIG. 18A, a side view of the heat gun 300 with a standard head 372 is illustrated. The standard head 372 includes two light bulbs 106 buried inside the head 320, in similar to the sweating head 322. The addition of a fan 344 located behind the light bulbs 106 pushes heated air to the front of the head 320. A reflective baffle wall 346 is fixedly positioned to diffuse most of the light coming from the light bulbs 106. There will be several nozzle styles (shown in relation to FIGS. 18B-18F) that an operator may attach to the tip of the head 320 that will simply and snuggly fit over the very tip such as a wide area nozzle 356 (shown in relation to FIG. 18D) and a small area nozzle 352 (shown in relation to FIG. 18B). One of these tips may be a plastic welding nozzle 354 (shown in relation to FIG. 18C) that will concentrate the hot air in a very small area being heated, and will be able to perform the task of plastic welding.

Because of the new heating method used, the heat gun 300 is immediately heated as soon as it is powered on. It may reach, for example, up to 1500 degrees F., or more depending on the focal point. The new heat gun 300 may perform the same task as any standard or industrial style heat gun on the market today. However, the new heat gun 300 may be much more versatile and may perform many other tasks utilizing the different nozzles 352-360 that may come with that head 320 attachment and it may be more economical to run than the old style, and may also be faster.

Standard Industrial heat guns put out about 650 to 700 degrees F. whereas the proposed heat gun 300 may more than double that output, and use less electricity in doing so, therefore costing less in the process. Also as an added feature a kit may come with the plastic welding nozzle 354 allowing more versatility with the product. Plastic welders range in price from 300 dollars on up to 1000 dollars, and have a heat range of 800 degrees on up to 1200 degrees. The proposed heat gun 300 may be capable of the same performance. There may be a variety of nozzles 352-360 that fit over the end of the heat gun 300, and provide the user with a choice for a variety of tasks.

Figure 18B:
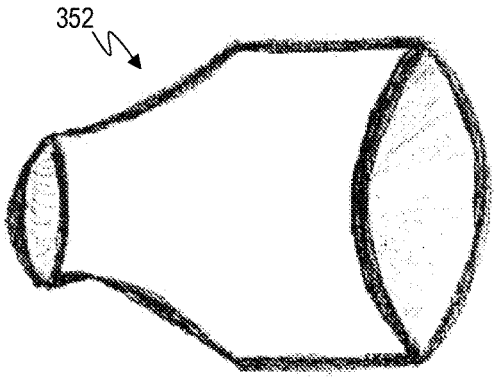
FIG. 18B is a side perspective view of a small area nozzle for the heat gun of FIG. 18A, according to an exemplary embodiment of the invention.
Figure 18C:
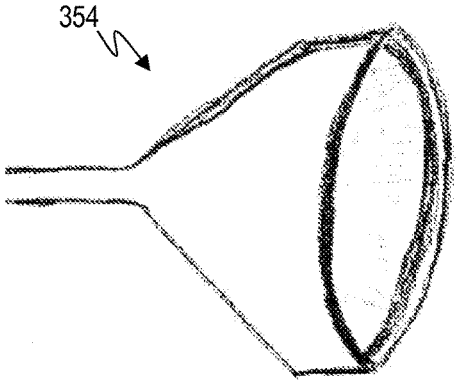
FIG. 18C is a side perspective view of a plastic welding nozzle for the heat gun of FIG. 18A, according to an exemplary embodiment of the invention.
Figure 18D:
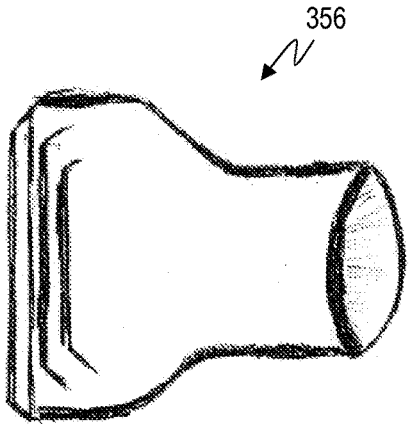
FIG. 18D is a side perspective view of a wide area nozzle for the heat gun of FIG. 18A, according to an exemplary embodiment of the invention.
Figure 18E:
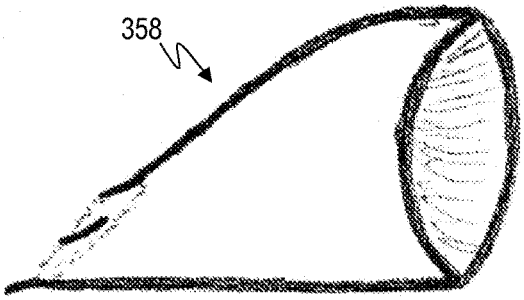
FIG. 18E is a side perspective view of a paint scraping nozzle for the heat gun of FIG. 18A, according to an exemplary embodiment of the invention.
Figure 18F:
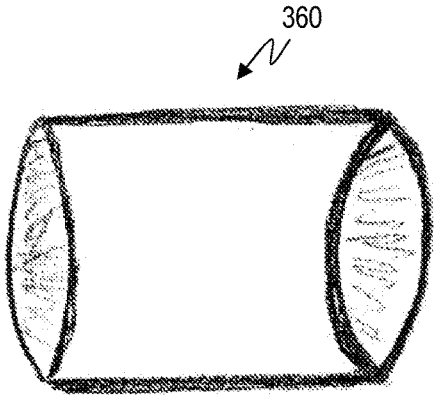
FIG. 18F is a side perspective view of a straight nozzle for the heat gun of FIG. 18A, according to an exemplary embodiment of the invention.

Referring now to FIGS. 18B-18F, a variety of nozzles are illustrated in side perspective views. FIG. 18B illustrates an exemplary small area nozzle 352 for the heat gun 300. FIG. 18C illustrates an exemplary plastic welding nozzle 354 for the heat gun 300. FIG. 18D illustrates an exemplary wide area nozzle 356 for the heat gun 300. FIG. 18E illustrates an exemplary paint scraping nozzle 358 for the heat gun 300. FIG. 18F illustrates an exemplary straight nozzle 360 for the heat gun 300.

Another nozzle (not shown) may be for plastic welding only, and include a flexible hollow shaft, perhaps a foot in length, with a plastic welding nozzle mounted at the tip of this shaft. This nozzle may allow the operator a lighter more controllable device to hold while welding, rather than the entire gun itself.

Referring back to FIG. 18A, adjacent to where the standard head 372 attaches to the body 318, may be a fan 344 which provides the air for the heat gun 300 in all modes. The fan 344 may have a high velocity blade to provide a maximum air flow to the nozzle 352-360. A reflective baffle wall 346 may be positioned immediately adjacent the fan 344 and angled back towards the tip of the of the heat gun 300. The reflective baffle wall 346 may be a partial wall and may be in alignment with both the upper and lower light bulbs 106. The reflective baffle wall 346 may be open to the sides so that airflow can pass all around the light bulbs 106. An insulated wall 348 may protect the operator and allow maximum heat to move towards the tip. An inner cone shaped heat sink wall 350 may be located in the middle in-between the upper and lower light bulbs 106. The heat sink wall 350 may be made of a material that soaks in the heat rather than reflecting the heat. On the inside of heat sink wall 350 may be a location for another light bulb if additional heat is necessary. A prototype with only two light bulbs reflecting inward towards the middle was capable of temperatures in excess of 1300 degrees. The additional light bulb may have a separate control or may be segregated by a temperature scale. The temperature may be set on the rheostat switch 302 in increments of, for example 100 degrees. The rheostat switch 304 and/or the fan switch 306 may be rotary switches 304. At 100 degrees only one bulb may be powered at 25%. At 200 degrees one bulb may be powered at 35%, etc. Finally, at 1300 degrees, all three bulbs may be powered at 100%. This is exemplary only. The fan 344 may also be controlled with a rheostat style switch 306, allowing more control for the different tasks this gun can perform.

Figure 19:
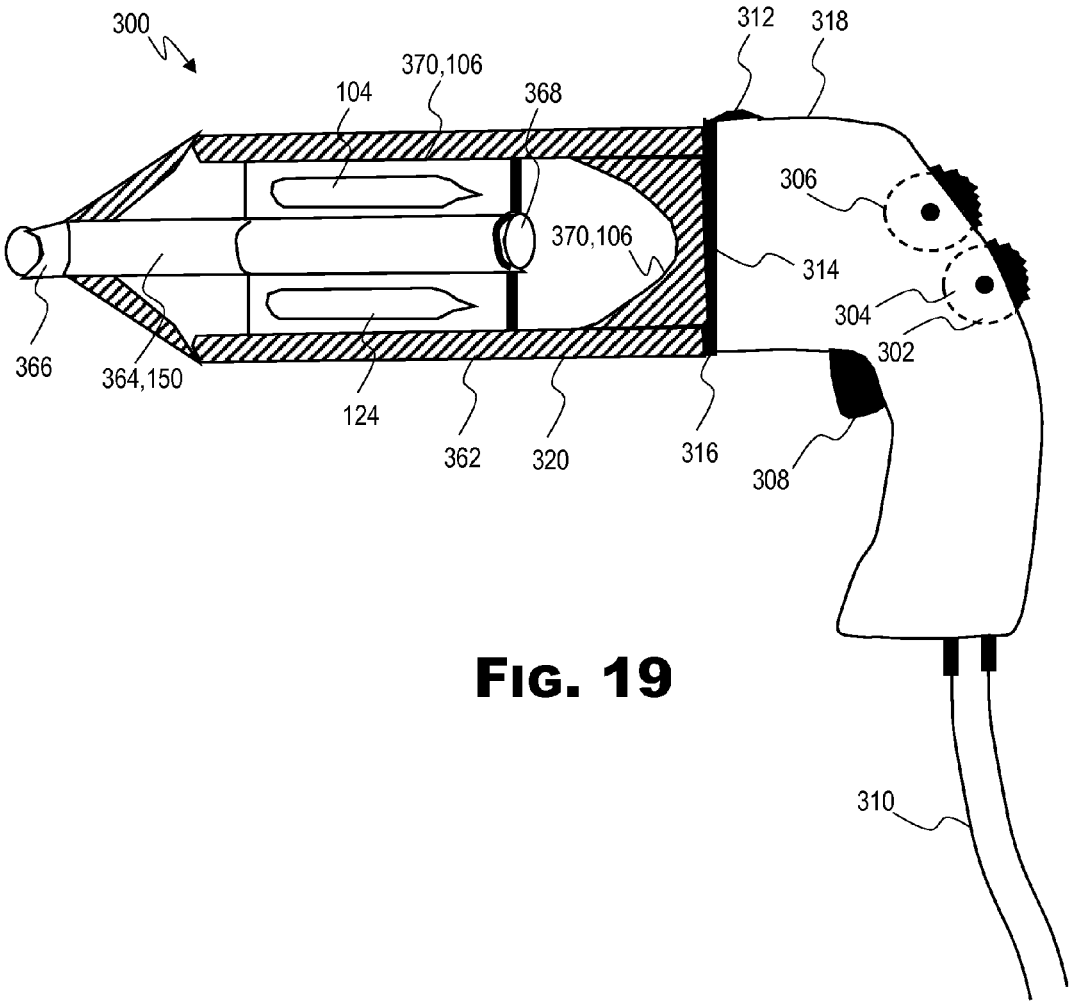
FIG. 19 is a side view of a heat gun, according to another exemplary embodiment of the invention.

Referring now to FIG. 19, a side view of a heat gun 300 with an exemplary soldering head 374 is illustrated. With the two light bulb 106 configuration described in relation to the sweating head 322 and a better reflector than the aluminum oxide, having for example, more of a mirrored surface, and concentrating the light to the center of the cylinder shaped head 320, with a ruby rod 364 and in the center mounted with a high mirror polish on an inner end 368 and a dull polish on an outer tip 366, a lasing action hot enough for welding purposes may be achieved. If the light bulbs 106 can generate enough light to excite the atoms into a high energy state, then those atoms will release the energy as photons and shoot down the ruby rod 364, causing the lasing action to occur. A proximity sensor (not shown) may be incorporated into the tip of the head 320, along with a sensor that may sense human tissue (not shown). The proximity sensor would sense if an object is too far away to cut or weld. In response to sensing such a condition, the heat gun 300 may not fire. In response to the other sensor sensing human tissue in close proximity the heat gun 300 would not fire.

The ruby rod 364 may be located in the center of the soldering head 374 such that it can be bombarded by the light bulbs 106 which may be above and below the ruby rod 364 to focus the light being emitted to the center of the ruby rod 364. By bombarding the ruby rod 364 in this fashion, the atoms may become super excited and release photons into the ruby rod 364. Once photons have been released into the ruby rod 364 it may produce a lasing action, creating a laser beam being projected out the outer tip 366 of the ruby rod 364. The outer tip 366 of the ruby rod 364 is only partially polished at the end, while the opposite inner end 368 has a high polish, creating a mirror like surface, so the photons will bounce off that end 368 and be released at the outer tip 366. The entire inside surface of the head 374 has highly polished walls 370 designed to bounce the light emitting from the light bulbs 360 towards the ruby rod 364. The ruby rod 364 may be secured in place so that it stays centered and non-moving.

Another use of the heating system 100 includes heated floors. Heated floors are nothing new, however they are becoming a popular option in the high-end housing market. One deterrent to installing a heated floor is a complicated installation process. Some systems use hot water and others use electrical resistance, however both may require several levels of installation. A level sub floor, a cement board over the sub floor, heated floor tubing and or grids over the cement board, and then tile may all be required. A light-weight panel with many cross sectional channels running at ninety degree angles to each other can be made with today's composite and plastics technology that would withstand a high traffic area such as a kitchen or main hallway. This panel would have a porous top and/or thousands of tiny holes in the top only. The cross sectional channels would add strength and allow air to be dispersed throughout the panel evenly. They could be custom made to order to allow customers to choose coloring and styling from a hard wood floor to ceramic tile. These panels could seal to each other and be locked into the adjoining panels. In some embodiment, small ducts may be installed along the edge of the floor to vent air, such as along the edge under cabinets in place of molding.

Another use for the heating system is in tank heaters. Tank heaters are used in various applications in various industrial venues, but their purpose, no matter where the application, is the same—they heat large volumes of a liquid substance. These heaters come in all shapes and sizes for a variety of installations, and going into a variety of environments. Many are in extreme conditions such as acid baths, or caustic baths or washes. The simplest form of tank heaters are classified as over the side heaters, and, as the name implies, they simply are placed over the side of the tank, and lowered into the liquid. It takes roughly 1000 watts of energy from one of these tank heaters, using the current standard, to heat 250 gallons of water to ten degrees above the ambient temperature.

This new system requires only a fraction of that energy and if the operator so desires, he/she may literally boil the water in the immediate area of the heater. The device may be extremely simple to manufacture. It may include a solid cylindrical piece of copper about two inches in diameter, at various lengths, depending on the depth of the tank it will be used in. The copper cylinder is then bored hollow to place the bulbs inside. The copper cylinder would be sleeved in stainless steel or other more exotic alloys, depending on the nature of the environment the heater will be exposed to. The bulbs may be set in place and secured in the position that would allow the most reflective angle against the copper core.

Another use for the heating system 100 includes water heaters. A new heating unit would be made to retrofit existing water heaters with old style heating units, including electrical or natural gas units. If a completely new unit is being installed, this heating system allows the consumer to install it in any location they so desire, as since no fossil fuels are being used, no need to vent to the outside is necessary. This allows more installation flexibility. The new heating unit may be sealed completely, thus eliminating explosions and other hazards that sometimes occur to natural gas hot water heaters. The new heating unit will be able to do the same job at approximately half the cost of an electrical heater, and approximately 70 to 85% of natural gas.

Another use for the heating system 100 includes residential furnaces. A new heating unit would be made to retrofit existing furnaces with old style heating units, including electrical or natural gas units. Since no fossil fuels are being consumed, a chimney or flu to vent to the outside is unnecessary. Therefore, 100% of the heat remains inside the house. The new heating unit will be able to do the same job at approximately half the cost of pure electricity, and approximately 70 to 85% or more of natural gas. A big advantage to the new unit would be no replacement costs of the old burner unit. In natural gas fired furnaces, the burner unit often needs replacing periodically. This may be expensive as the task is usually done by a service technician and is not a job that the average homeowner would take on. As with all the new style heating units, the heat is supplied by the tungsten light bulb. If one burns out, you simply replace that bulb. This may be no more difficult than replacing a bulb in your table lamp. An add on to the furnace would be an individual register unit: This device could be put at individual registers to boost the hot air coming into a particular room By putting a single bulb heater with a booster fan behind the unit you could boost the hot air coming in from that one duct register, thus giving the home owner more control over his/her furnace, and providing a greater comfort level to each individual room. By hooking up these individual units to a central brain and having mass air flow sensors on each unit, the furnace could run with greater efficiency then before. Using this central brain would allow the homeowner to control each room in his/her home at an individual level. If a room is essentially unused, it can be cut off, allowing more of the heat being produced to go where it is desired.

In some embodiments, rather than replacing the entire heating system, the old heating unit may be replaced with the new one, and the existing duct work and blower motor unit may remain in place.

It should be understood, of course, that the foregoing relates to exemplary embodiments of the invention and that modifications may be made without departing from the spirit and scope of the invention as set forth in the following claims.

We claim:

1. A clothes dryer, comprising:

a drum for placing clothing to be dried, the drum configured to rotate;

an air conduit fluidly connected to the drum at a drum end for providing warm air to the drum for drying the clothing, the air conduit including an interior;

an electric power source;

at least one heating unit fixedly positioned in the interior of the air conduit, the heating units each comprising:

a reflector including a reflecting surface, a light bulb configured to emit light onto the reflecting surface when connected to the electric power source; and a socket selectively electrically connected to the electric power source, the light bulb removeably connected to the socket; and a heat sink fixedly mounted in the interior of the air conduit and positioned such that the reflecting surface reflects at least a portion of the light onto the heat sink; and a controller configured to selectively connect the socket to the electric power source.

2. The clothes dryer of claim 1, wherein:

the air conduit includes an interior surface; and at least one of the heating units is fixedly mounted to the interior surface.

3. The clothes dryer of claim 1, wherein the heat sink includes a porous member positioned between the at least one heat units and the drum end of the air conduit.

4. The clothes dryer of claim 3, wherein the heat sink includes a metal mesh forming multiple air channels.

5. The clothes dryer of claim 1, wherein the air conduit has a second intake end, and further including at least one porous member positioned between the intake end and the at least one heat units.

6. The clothes dryer of claim 1, wherein:

the air conduit interior surface includes a front, a back, a first side, and a second side;

two heating units are mounted on the back of the interior surface, one heating unit is mounted on the first side of the interior surface, and on heating unit is mounted on the second side of the interior surface; and the front of the interior surface includes a vent for directing air into the drum.

7. The clothes dryer of claim 6, wherein the heat sink is a porous metal member positioned adjacent the vent in the interior of the air conduit.

8. The clothes dryer of claim 1, wherein the heat sink includes a housing with a first open end and a second open end mounted in the interior of the air conduit.

9. The clothes dryer of claim 8, wherein the heat sink includes an interior surface, and at least one the heat units is mounted on the interior surface of the heat sink and at least partially enclosed by the heat sink.

10. The clothes dryer of claim 1, wherein the light bulb of each heating unit comprises a tungsten halogen light bulb.

* * * * *